United States Patent [19]

McCormack

[11] Patent Number: 5,008,515

[45] Date of Patent: Apr. 16, 1991

[54] BODY TEMPERATURE RESPONSIVE TRANSPORT WARMING BLANKET

[76] Inventor: William C. McCormack, 3703 Woodland St., Ames, Iowa 50010

[21] Appl. No.: 521,410

[22] Filed: May 10, 1990

[51] Int. Cl.[5] ..... H05B 3/34

[52] U.S. Cl. ..... 219/212; 219/516

[58] Field of Search ..... 219/212, 516, 528, 529, 219/549

[56] References Cited

U.S. PATENT DOCUMENTS

| | | | |
|---|---|---|---|
| 1,356,965 | 10/1920 | Charles | 219/212 |
| 3,072,776 | 1/1963 | Quennneville | 219/212 |
| 3,338,233 | 8/1967 | Grosholz | 219/516 |
| 4,788,417 | 11/1988 | Graflind | 219/212 |

FOREIGN PATENT DOCUMENTS

| | | | |
|---|---|---|---|
| 979851 | 5/1951 | France | 219/212 |

*Primary Examiner*—Teresa J. Walberg

*Attorney, Agent, or Firm*—Zarley, McKee, Thomte, Voorhees & Sease

[57] ABSTRACT

An infant warming blanket is servo controlled by a temperature probe being taped to the abdominal skin of the infant. Through use of the blanket it is possible to maintain a constant body temperature. Access to localized areas of the body is possible by removal of blanket strips to expose the area requiring attention. The blanket has a first solid section to which a second section of individual strips having varying widths are integrally attached. The electrical heating elements run through both sections.

6 Claims, 1 Drawing Sheet

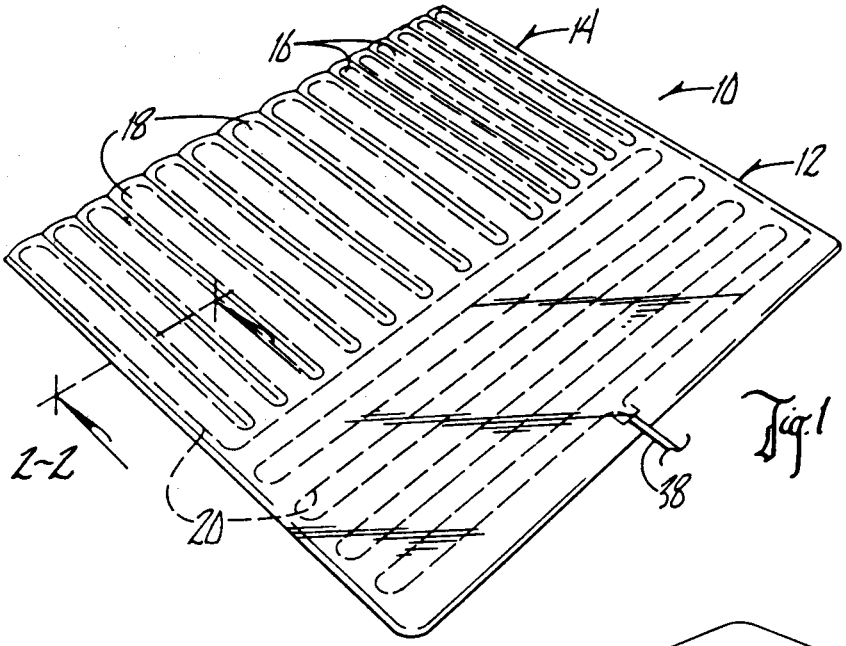
Fig. 1
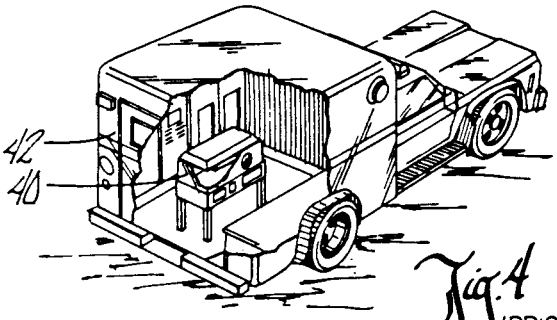
Fig. 4 (PRIOR ART)
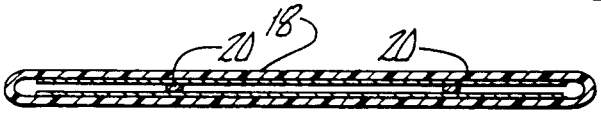
Fig. 2
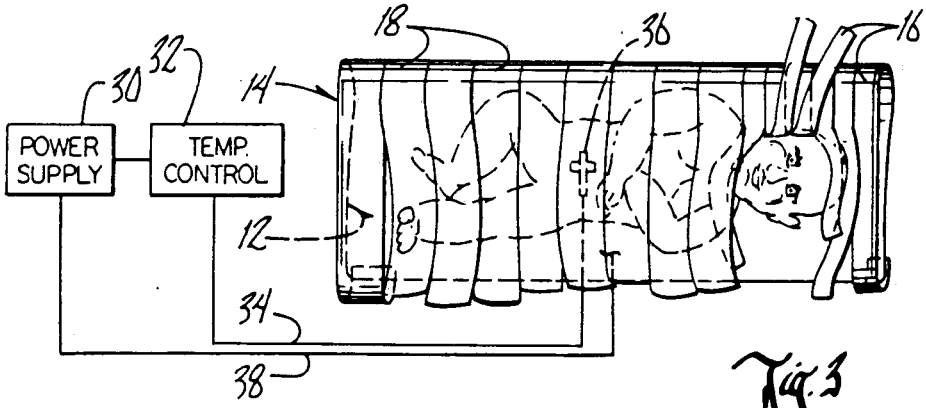
Fig. 3
Fig. 4

BODY TEMPERATURE RESPONSIVE TRANSPORT WARMING BLANKET

BACKGROUND OF THE INVENTION

In working with premature and sick infants it is very important that the desired body temperature be consistently maintained. This may also be true with certain older patients such as wet victims and those in shock whose circulation has been compromised.

A particular problem with infants and especially preterm infants is that they will need to be transferred from a hospital lacking equipment and specialists to a hospital that can meet the infant's needs. It is during this transfer that it is critical to maintain consistent skin temperature. A premature child has a large surface-to-volume ratio and heat is lost in proportion to the surface area. Premature infants are especially vulnerable because they do not have the usual subcutaneous fat layer gained in the last month of pregnancy.

A conservative estimate of the number of premature infants who might require such specialized care is 22,000 which is the number born each year in the United States weighing less than 1500 grams. It is estimated that one-third of these may be transferred between hospitals and thus will encounter the body temperature problems discussed. If we consider larger infants and term babies, the number would be much greater and perhaps on the order of 100,000 infants per year.

Visual and hand access to the infant is important. The infant must be watched for changes in skin color, type of breathing, chest respiratory movement, vomiting and convulsions. The various invasive tubes must be watched for proper position and function. The endotracheal tube, the intravenous tube, the intraarterial tube, the stomach tube, the urinary catheter, etc. must all be accommodated and serviced. Attention to these items usually means increased exposure to the environmental temperature and increased body heat loss.

The current state-of-the-art includes several unsatisfactory approaches to dealing with this problem. An isolette may be used which is a plastic box supplied with heated air as a means of infant temperature maintenance. Heat loss is by radiation to the walls and by exposure to cool air. Access is limited to arm holes in the sides of the isolette, unless the lid on the box is raised. A transport isolette, which is a modified isolette, is self contained on wheels which includes a respirator, a battery pack, suction apparatus and monitors. The infant is accessed only from above through the raising of a hinged cover. Another approach to this problem is the use of a semitrailer for transport of one or more full sized neonatal intensive care units. The bed surface is about four feet high and the infant is heated by radiant heaters about three to four feet above the bed. The radiant heaters are ineffective as they may be easily blocked by the bodies of medical personnel or drapes or the like.

Known warming pads available have crude control systems that do not respond to changes in body temperature. None of them are thermostatically regulated to keep the patient's skin at a constant temperature. The electrothermal blanket in Charles U.S. Pat. No. 1,356,965 is such a heated blanket. A heating blanket is shown in the Endo U.S. Pat. No. 4,656,334 but the control merely senses the presence of a body under the blanket and turns the setting of the blanket from high to another lower preset temperature. This thermostat is not intended to regulate the body temperature of the occupant but simply keep the blanket from staying uncomfortably hot when the user goes to sleep without requiring the user to turn it down.

SUMMARY OF THE INVENTION

An objective of this invention is to maintain a constant body temperature by monitoring the skin temperature and maintaining it at the desired temperature for the body.

A warming transport blanket is provided which is servo controlled by a temperature probe being taped to the abdominal skin of the child. The electrical heating elements in the blanket will maintain a constant body temperature for the child as the heating elements will only be operative as required to maintain the desired temperature in response to the infants temperature needs as indicated by the temperature probe.

The blanket has two sections with the first being solid and the second having a plurality of strips independently operable and adapted to provide access to selected areas of the body wrapped in the blanket. The width of the strips will vary with strips having a smaller width being provided in the area covering the head and neck to provide very localized access to the infant for medical treatment.

DESCRIPTION OF THE DRAWINGS

FIG. 1 is a perspective view of the transport warming blanket.

FIG. 2 is a cross-sectional view taken along line 2—2 in FIG. 1.

FIG. 3 is a top plan view of the blanket wrapped around a child and additionally showing an electrical schematic.

FIG. 4 is a perspective view of a prior art vehicle including an isolette.

DESCRIPTION OF THE PREFERRED EMBODIMENT

The servo controlled warming blanket of this invention is referred to generally in FIG. 1 by the reference numeral 10 and is seen to have a first section 12 to which a second section 14 is integrally connected. The second section 14 includes a plurality of strips 16 and 18 extending laterally of the longitudinal axis of the blanket. The strips 16 are narrower in width than the strips 18 to provide more localized access to the infant such as in the neck and head area.

Electrical heating elements 20 run throughout both of the sections 12 and 14 to provide heating throughout the entire blanket. The blanket is covered with a plastic material for ease of care and cleanliness. A power supply 30 is seen in FIG. 3 connected to a temperature control 32 which in turn is connected by a conductor 34 to the blanket 10. An abdominal temperature probe sensor 36 is connected by a conductor 38 to the power supply 30. These controls are available through Ohmeda, Columbia, Md. The heat provided would be proportional heat with zero voltage switching to minimize radiated and conducted EMI. The amount of heat supplied would relate to the amount of heat needed to maintain the desired temperature. If a large amount of heat was required to raise the body temperature a significant amount, then such would be provided but if only a small amount is required a proportionally less amount of heat would be provided. An Ohmeda temperature sensing probe model No. LA-003 may be used having a range of 22° C. to 42° C. with an accuracy of ±0.3° C. and a resolution of ±0.1° C. and a probe interchangeability ±0.1° C.

In use it is seen that the child would be placed on the solid section 12 of the blanket initially with the strips 16 and 18 of section 14 being laid over the top of the infant and then snugly positioned under the section 12 as seen in FIG. 3. The temperature sensing probe 36 would be attached to the infant's abdominal area by tape and the temperature control would be set to a temperature at which it is desired to maintain the infant's body temperature. Access to the infant is quick and easy by simply lifting one or more of the strips 16 and 18 in the area requiring attention. The infant will not lose significant body heat through this limited exposure. Any heat lost which is sufficient to drop skin temperature will be compensated for by the remainder of the blanket still wrapped around the infant. This system avoids the cumbersome and bulky prior art equipment such as shown in FIG. 4 wherein an isolette 40 utilizing convection heat is taken from the hospital and placed in an emergency vehicle 42 for transport of the infant between hospitals. The servo controlled warming blanket of this invention is very flexible such that the infant could even be held on the lap of an adult in the warming blanket while being transported and while maintaining the desired consistent skin temperature.

I claim:

1. A body temperature responsive transport warming blanket comprising, a blanket having a first section integrally connected to a second section, said second section including a plurality of strips independently operable and adapted to provide access to selected areas of the body wrapped in said blanket, electrical heating elements extending substantially throughout said first and second sections including said plurality of strips, and an electrical control circuit including said heating elements, a power supply and a skin contact temperature sensor adapted to be attached to said body, and a temperature control means adapted to be adjusted to a predetermined desired body temperature which is substantially continuously maintained throughout operation and use of the blanket by said heating element being operative only as required and indicated by said temperature sensor to maintain said predetermined desired body temperature within a narrow range.

2. The structure of claim 1 wherein said blanket has a longitudinal axis with said plurality of strips extending laterally of the longitudinal axis.

3. The structure of claim 2 wherein said plurality of strips have longitudinal axis and widths which vary thereby being adapted to provide varying amounts of blanket coverage over different parts of said body.

4. The structure of claim 2 wherein said blanket including said plurality of strips has a width sufficient to be adapted to wrap around said body with said strips being overlapped onto said first section of said blanket.

5. The structure of claim 4 wherein said first section is adapted to underlie said body with said second section including said plurality of strips overlying said body and being adapted to be folded back to expose and give access to a selected area of said body.

6. The structure of claim 1 wherein said narrow range of temperature is further defined as being approximately ±0.3° C.

* * * * *

UNITED STATES PATENT AND TRADEMARK OFFICE

CERTIFICATE OF CORRECTION

PATENT NO. : 5,008,515

DATED : April 16, 1991

INVENTOR(S) : William C. McCormack

It is certified that error appears in the above-indentified patent and that said Letters Patent is hereby corrected as shown below:

Column 1, line 43, change "isolette" to read -- incubator --.

Column 1, line 47, change "isolette" to read -- incubator --.

Column 1, line 48, in both occurrences change "isolette" to read -- incubator --.

Column 2, line 39, change "isolette" to read -- incubator --.

Column 3, line 22, change "isolette" to read -- incubator --.

Signed and Sealed this

Eighteenth Day of January, 1994

*Attest:*

Bruce Lehman

BRUCE LEHMAN

*Attesting Officer*

*Commissioner of Patents and Trademarks*